US007704115B2

(12) United States Patent
Matsuo

(10) Patent No.: US 7,704,115 B2
(45) Date of Patent: Apr. 27, 2010

(54) SUPPORTING STRUCTURE, METHOD OF MANUFACTURING SUPPORTING STRUCTURE, AND DISPLAY APPARATUS USING THE SAME

(75) Inventor: Yuji Matsuo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 379 days.

(21) Appl. No.: 11/183,979

(22) Filed: Jul. 19, 2005

(65) Prior Publication Data

US 2006/0027816 A1 Feb. 9, 2006

(30) Foreign Application Priority Data

Aug. 4, 2004 (JP) ..... 2004-227516

(51) Int. Cl.
*H01J 9/00* (2006.01)

(52) U.S. Cl. ..... 445/24; 313/586

(58) Field of Classification Search ..... 313/495–497, 313/306, 309–310, 346, 351, 355, 293–304; 445/24

See application file for complete search history.

(56) References Cited

U.S. PATENT DOCUMENTS

| | | | | |
|---|---|---|---|---|
| 4,558,255 | A * | 12/1985 | Genovese et al. | 313/497 |
| 5,939,822 | A | 8/1999 | Alderson | 313/493 |
| 6,246,026 | B1 * | 6/2001 | Vergeest | 219/121.72 |
| 6,617,772 | B1 * | 9/2003 | Barton et al. | 313/292 |
| 6,803,715 | B1 * | 10/2004 | Mitsutake et al. | 313/495 |
| 2002/0031974 | A1 * | 3/2002 | Ito et al. | 445/24 |
| 2003/0141803 | A1 | 7/2003 | Fushimi | 313/495 |
| 2004/0070325 | A1 * | 4/2004 | Nakata | 313/292 |
| 2004/0075378 | A1 | 4/2004 | Niibori et al. | 313/495 |
| 2004/0113540 | A1 * | 6/2004 | Niibori et al. | 313/495 |
| 2004/0214432 | A1 * | 10/2004 | Masumoto | 438/689 |

FOREIGN PATENT DOCUMENTS

| | | |
|---|---|---|
| JP | 2000-251705 | 9/2000 |
| JP | 2003-229056 | 8/2003 |
| JP | 2003-303561 | 10/2003 |
| JP | 2003-317649 | 11/2003 |
| JP | 2004-014131 | 1/2004 |
| JP | 2004-014199 | 1/2004 |
| WO | WO 03/092035 | 11/2003 |

* cited by examiner

*Primary Examiner*—Peter J Macchiarolo
*Assistant Examiner*—Donald L Raleigh
(74) *Attorney, Agent, or Firm*—Fitzpatrick, Cella, Harper & Scinto

(57) ABSTRACT

A display apparatus includes a first substrate having an electron-emitting device, a second substrate having a light emitting member that emits light through irradiation with electrons emitted from the electron-emitting device and an electrode, and a plate-like supporting structure which is situated between the first substrate and the second substrate to support the two substrates and which has in its surface a plurality of grooves parallel to the first substrate or the second substrate. End portions of the grooves are spaced apart from an end portion of the supporting structure which does not face the first substrate or the second substrate by a distance longer than a thickness of the plate-like supporting structure.

6 Claims, 7 Drawing Sheets

SUPPORTING STRUCTURE, METHOD OF MANUFACTURING SUPPORTING STRUCTURE, AND DISPLAY APPARATUS USING THE SAME

BACKGROUND OF THE INVENTION

1. Field of the Invention

The present invention relates to a supporting structure to be used as an atmospheric-pressure-resistant means of a vacuum container in a flat-type display apparatus which is constructed using an electron-emitting device, and to a method of manufacturing the same. The present invention further relates to a display apparatus which is constructed using the supporting structure.

2. Related Background Art

Generally speaking, in a display apparatus in which a first substrate, which is an electron source substrate equipped with a plurality of electron-emitting devices, and a second substrate are opposed to each other with a space therebetween, a supporting structure (spacer) formed of an insulating material is held between the first substrate and the second substrate in order to attain the requisite resistance to the atmospheric pressure.

In a known method of manufacturing such a supporting structure, a glass base material is subjected to heat drawing and is cut to a predetermined length by a diamond cutter or through laser beam irradiation (Japanese Patent Application Laid-open No. 2000-251705). Further, as is known in the art, it is possible to prevent charging of a supporting structure by providing a plurality of grooves in the surface of the supporting structure. Also as a method of manufacturing a supporting structure with a plurality of grooves in the surface thereof, a method is known in which a glass base material is subjected to heat drawing and is cut to a predetermined length by a diamond cutter or through laser beam irradiation (Japanese Patent Application Laid-open No. 2003-229056). The known method, however, has a problem in that stress is concentrated on minute protrusions and chips, generated in the section in the cutting process, resulting in buckling destruction of the supporting structure; further, due to concentration of an electric field on such protrusions and chips, surface discharge is likely to occur.

In view of this, Japanese Patent Application Laid-open No. 2000-251705 discloses a manufacturing method according to which smoothing of the section obtained through cutting is effected by performing heating or chemical etching processing on the supporting structure after the cutting, thereby preventing buckling destruction and surface discharge of the supporting structure.

However, when a supporting structure with grooves formed in the surface thereof for charging prevention is to be manufactured, the manufacturing method as disclosed in Japanese Patent Application Laid-open No. 2000-251705 involves a change in the configuration of the grooves (the depth, angle, and ridge portion configuration thereof) due to annealing and chemical etching, so that it is impossible to achieve a desired charging prevention effect.

SUMMARY OF THE INVENTION

The present invention has been made with a view toward solving the above-mentioned problem in the prior art. It is an object of the present invention to provide a supporting structure which exhibits high fracture resistance and in which charging prevention is effected through provision of desired grooves in the surface thereof without adding any complicated process, and to realize a display apparatus of high reliability by using the supporting structure.

First, the present invention is characterized in that a supporting structure including a plate-like base material which has in its surface a plurality of grooves parallel to the longitudinal direction of the base material and which supports a component of a display apparatus with its end portion parallel to the longitudinal direction of the base material, in which end portions of the grooves are spaced apart from an end portion of the base material parallel to the lateral direction of the base material.

Second, the present invention is characterized in that a supporting structure including a plate-like base material which has in its surface a plurality of grooves parallel to the longitudinal direction of the base material and which supports a component of a display apparatus with its end portion parallel to the longitudinal direction of the base material, in which a curved portion having a radius of curvature larger than the thickness of the base material is provided at an end portion of the base material parallel to the lateral direction of the base material.

Third, the present invention is characterized in that a method of manufacturing a plate-like supporting structure having in its surface a plurality of grooves, the method including the steps of subjecting a plate-like glass base material having in its surface a plurality of grooves to heat drawing in a direction parallel to the grooves; and cutting the glass base material through irradiation of the glass base material after the heat drawing with laser beam from a direction perpendicular to the surface having the grooves of the glass base material, in which in the step of cutting the glass base material, with an irradiation region of the glass base material irradiated with the laser beam being molten, one side portion of the glass base material with respect to the irradiation region is pulled to thereby cut the glass base material in the irradiation region.

Fourth, the present invention is characterized in that a display apparatus including a first substrate having an electron-emitting device, a second substrate having a light emitting member adapted to emit light through irradiation with electrons emitted from the electron-emitting device and an electrode, and a plate-like supporting structure which is situated between the first substrate and the second substrate to support the two substrates and which has in its surface a plurality of grooves parallel to the first substrate or the second substrate, is characterized in that end portions of the grooves are spaced apart from an end portion of the supporting structure which does not face the first substrate or the second substrate.

Fifth, the present invention is characterized in that a display apparatus including a first substrate having an electron-emitting device, a second substrate having a light emitting member adapted to emit light through irradiation with electrons emitted from the electron-emitting device and an electrode, and a plate-like supporting structure which is situated between the first substrate and the second substrate to support the two substrates and which has in its surface a plurality of grooves parallel to the first substrate or the second substrate, in which a curved portion having a radius of curvature larger than the thickness of the supporting structure is provided at an end portion of the supporting structure which does not face the first substrate or the second substrate.

In the supporting structure of the present invention, which has grooves in the surface thereof, its charging property is controlled. Further, since the grooves do not reach an end portion, stress concentration due to the protrusions and recesses of the grooves is mitigated, whereby a superiority in compressive strength and flexural strength is attained.

Further, in the supporting structure of the present invention, which has grooves in the surface thereof, its charging property is controlled; further, at an end portion thereof, there is provided a curved portion having a radius of curvature larger than the thickness of the supporting structure, so that the curved portion serves as a reinforcing member for the supporting structure, whereby a superiority in compressive strength and flexural strength is attained.

Further, by the manufacturing method of the present invention, it is possible to manufacture a supporting structure with grooves of a desired configuration without adding any complicated process.

In the display apparatus of the present invention, which uses the supporting structure of the present invention, the charging of the supporting structure with electrons emitted is controlled in a satisfactory manner; further, the supporting structure itself is superior in terms of strength, whereby it is possible to realize a high quality image display and a high level of reliability.

Thus, in accordance with the present invention, it is possible to provide a supporting structure superior in strength compared to the conventional supporting structure without involving any substantial increase in production cost. Further, by using the supporting structure, it is possible to provide a display apparatus of high image quality and high reliability.

DESCRIPTION OF THE PREFERRED EMBODIMENTS

In the following, a supporting structure of the present invention, a display apparatus using the supporting structure, and a method of manufacturing the supporting structure will be described with reference to preferred embodiment modes.

Figure 8:
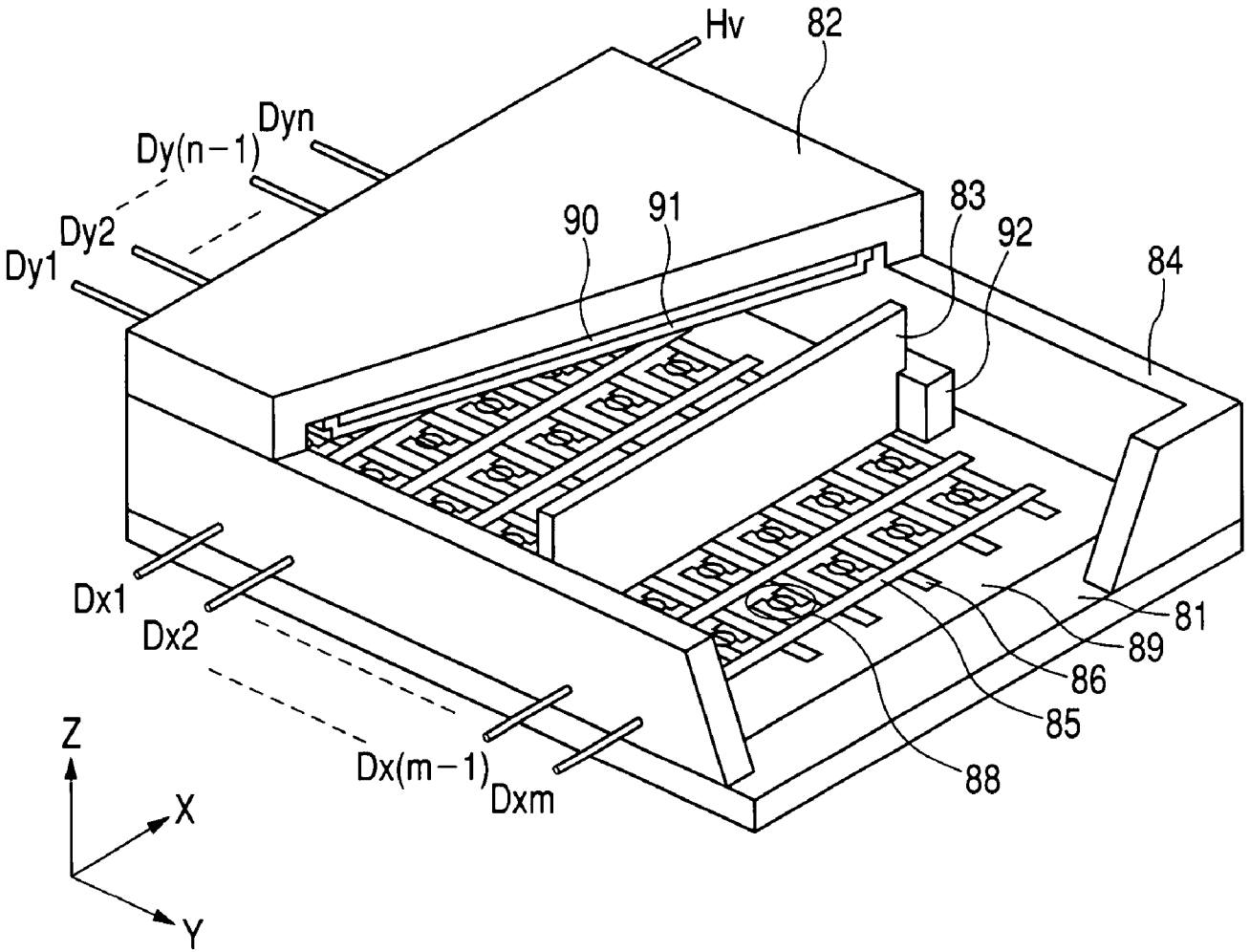
FIG. 8 is a diagram showing a construction of the display panel of a display apparatus according to a present invention.

FIG. 8 is a partially cutaway perspective view showing the construction of the display panel of a display apparatus according to a preferred embodiment mode of the present invention.

As shown in FIG. 8, in the display panel of this embodiment mode, a rear plate 81, which constitutes a first substrate, and a face plate 82, which constitutes a second substrate, are opposed to each other with a space therebetween, and a flat-plate-like supporting structure (hereinafter also referred to as the spacer) 83 is held between the two substrates; further, the periphery of the display panel is sealed by a side wall 84, and a vacuum atmosphere is created in the interior.

Fixed to the rear plate 81 is an electron source substrate 89, on which there are formed row-directional wirings 85, column-directional wirings 86, an inter-layer insulating layer (not shown), and electron-emitting devices 88.

Each of the electron-emitting devices 88 shown in the drawing is a surface conduction electron-emitting device in which a conductive thin film with an electron-emitting portion is connected between a pair of device electrodes. In this embodiment mode, N×M surface conduction electron-emitting devices 88 are arranged, and there is provided a multi-electron-beam source with M row-directional wirings 85 and N column-directional wirings 86, which are respectively arranged at equal intervals. Further, in this embodiment mode, the row-directional wirings 85 are situated over the column-directional wirings 86 through the intermediation of the inter-layer insulating layer (not shown). A scanning signal is applied to the row-directional wirings 85 via lead-out terminals Dx1 through Dxm, and a modulation signal (image signal) is applied to the column-directional wirings 86 through lead-out terminals Dy1 through Dyn.

On the lower surface of the face plate 82 (i.e., the surface opposed to the rear plate 81), there is formed a phosphor film 90 as a light emitting member; further, on the surface of the phosphor film 90, there is provided a metal back (acceleration electrode) 91, which is a conductive member. The metal back 91 serves to accelerate the electrons emitted from the electron-emitting devices 88; it is set to an electric potential higher than that of the row-directional wirings 85 by applying a high voltage thereto from a high voltage terminal Hv.

A flat-plate-like spacer 83 is mounted over the row-directional wirings 85 so as to extend parallel to the row-directional wirings 85. With spacer fixing blocks 92 mounted to both ends thereof, the spacer 83 is fixed to the electron source substrate 89 in a state where it is placed on the row-directional wirings 85. By fixing the spacer 83 by using the spacer fixing blocks 92, it is possible to diminish the disturbance of the electric field in the vicinity of the electron-emitting devices 88, where the kinetic energy of the electrons is small and the electron orbit is subject to the influence of the electric field.

Figure 9:
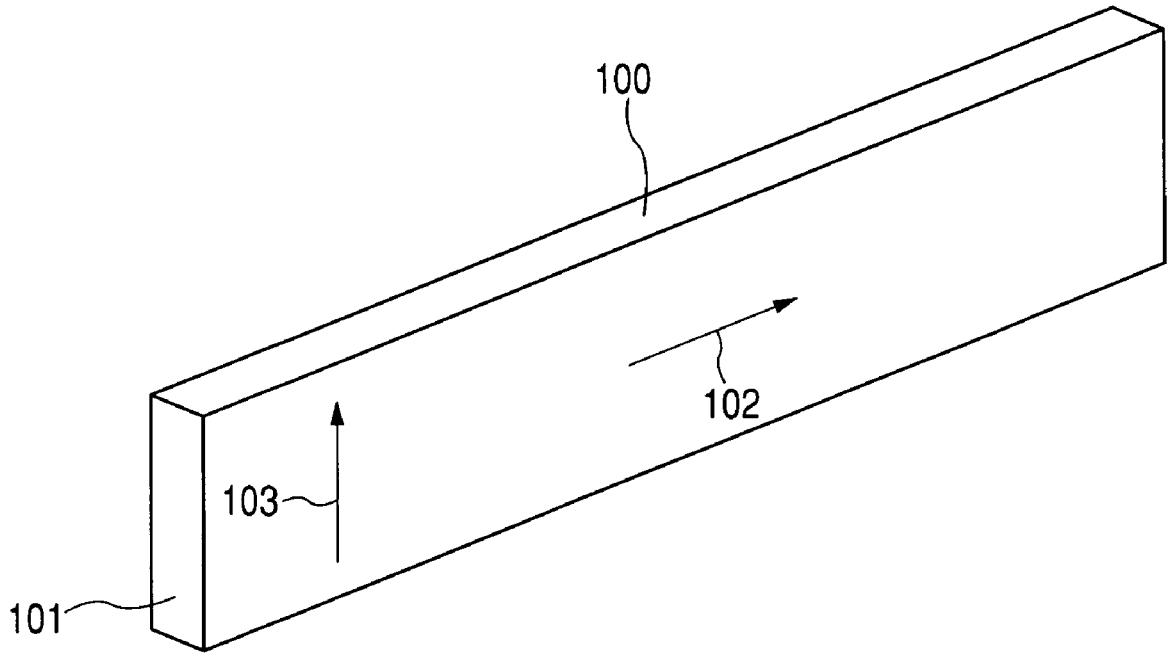
FIG. 9 is a partial enlarged view of a supporting structure (spacer).

FIG. 9 only shows the spacer of FIG. 8. In FIG. 9, numeral 100 indicates an end portion of the spacer which faces the face plate or the rear plate, and numeral 101 indicates an end portion of the spacer which does not face the face plate or the rear plate. In other words, numeral 100 indicates an end portion parallel to the longitudinal direction of the spacer, and numeral 101 indicates an end portion parallel to the lateral direction of the spacer. An arrow 102 indicates the longitudinal direction of the spacer (the X-direction in FIG. 8), and an arrow 103 indicates the lateral direction of the spacer (the Z-direction in FIG. 8).

The spacer 83 is held between the rear plate 81 having the electron source substrate 89 and the face plate 82 on which the phosphor film 90 and the metal back 91 are provided, with the upper and lower surfaces of the spacer 83 being respectively in press contact with the metal back 91 and the row-directional wirings 85. To endow the display panel with resistance to the atmospheric pressure, a plurality of spacers 83 are usually provided at equal intervals. Further, in the peripheries of the rear plate 81 and face plate 82, the side wall 84 is sandwiched therebetween, and the bonding portion between the rear plate 81 and the side wall 84 and the bonding portion between the face plate 82 and the side wall 84 are each sealed by frit glass or the like.

Figure 1A:
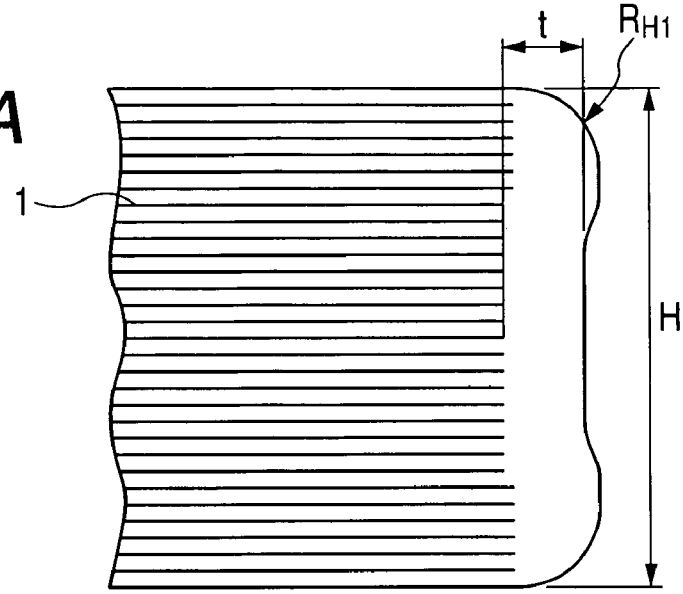
FIGS. 1A and 1B are diagrams showing a supporting structure according to a preferred embodiment mode of the present invention.
Figure 1B:
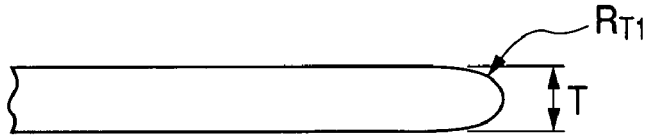

FIGS. 1A and 1B show the first supporting structure of the present invention, that is, a preferred embodiment mode of the spacer 3 of FIG. 8. FIG. 1A is a side view (an X-Z plan view of the spacer as seen in the Y-direction in FIG. 8), and FIG. 1B is a top view (an X-Y plan view of the spacer as seen in the Z-direction in FIG. 8; the drawing shows the end surface facing and abutting the face plate 82 of the spacer). FIGS. 2A and 2B, 3A and 3B, 4A and 4B, and 5A and 5B are also views as seen in the same directions as in FIGS. 1A and 1B, respectively.

As shown in FIGS. 1A and 1B, the supporting structure of the present invention is formed as a flat plate having on the surface thereof a plurality of grooves 1 that are parallel to the first substrate and second substrate, in which the grooves 1 do not reach an end portion of the supporting structure, which is a feature of the present invention. In other words, the end portions of the grooves 1 are spaced apart from the end portions of the supporting structure which do not face the rear plate or the face plate. Due to the fact that the grooves 1 do not reach the end portions of the supporting structure, it is possible to secure a sufficient strength in terms of fracture resistance. It is desirable for the length (t) of the region with no grooves 1 to be equivalent to or larger than the thickness (T) of the supporting structure. This is due to the fact that in the step of cutting the drawn glass substrate in the manufacturing method of the present invention described below, there is established an interrelationship between the length (t) of the region with no grooves 1 and the configuration of the end portion of the supporting structure extending perpendicularly to the substrates.

As shown in FIG. 1B, within the range of the thickness (T), it is desirable for the end portion to be of a gently rounded configuration ($R_{T1}$). In this regard, when at least the configuration $R_{T1}$ is an outwardly protruding rounded configuration, the possibility of the end portion being chipped is reduced when the end portion comes into contact with some other component during the so-called handling, in which a display panel is assembled by using the supporting structures according to this embodiment mode.

Figure 2A:
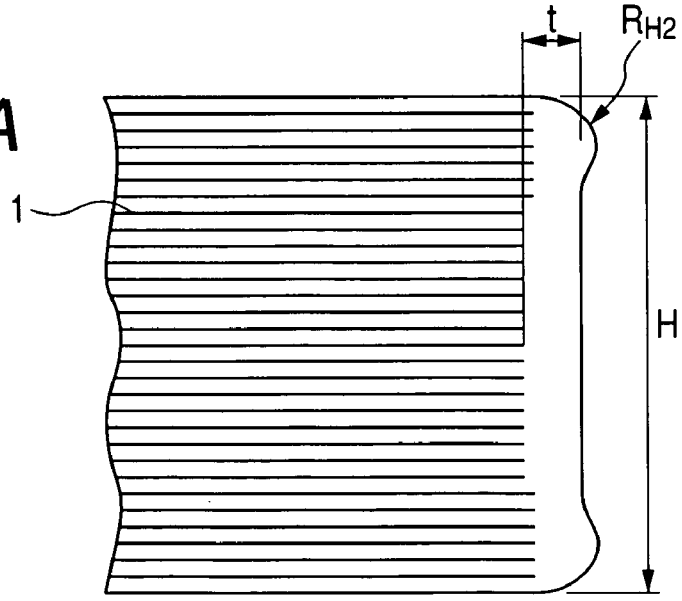
FIGS. 2A and 2B are diagrams showing a supporting structure according to another embodiment mode of the present invention.
Figure 2B:
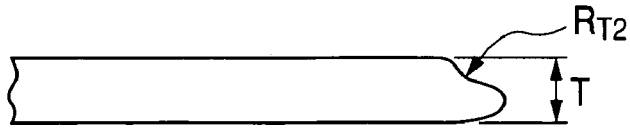

As shown in FIGS. 2A and 2B, depending upon the condition for the cutting process, the length (t) of the region with no grooves 1 may be less than the thickness (T) of the supporting structure; in this case, the end portion has an outwardly recessed rounded configuration ($R_{T2}$). In the case of this configuration, while no problem in terms of fracture resistance is involved since the grooves 1 do not reach the end portions, care must be taken in handling the supporting structure. For, since the end portions have oppositely directed curved configurations, that is, pointed configurations, there is a fear of the end portions being chipped when the end portions come into contact with some other component during the handling, i.e., when assembling the display panel by using such a supporting structure, which means care must be taken in handling.

Further, also regarding the rounded configurations ($R_{H1}$ in FIG. 1A and $R_{H2}$ in FIG. 2A) existing in the height (H) direction (the Z-direction in FIG. 8), it is desirable for the end portions to be of curved configurations as gentle as possible. Comparison of the configuration $R_{H1}$ of FIG. 1A and the configuration $R_{H2}$ of FIG. 2A shows that when the end portion configuration thereof is of an oppositely directed curvature ($R_{T2}$), the configuration $R_{H2}$ is apparently of a smaller curvature than the configuration $R_{H1}$ of FIGS. 1A and 1B, which means, it is a somewhat pointed configuration. That is, the end portion as shown in FIGS. 2A and 2B is of a configuration subject to chipping during handling.

Figure 3A:
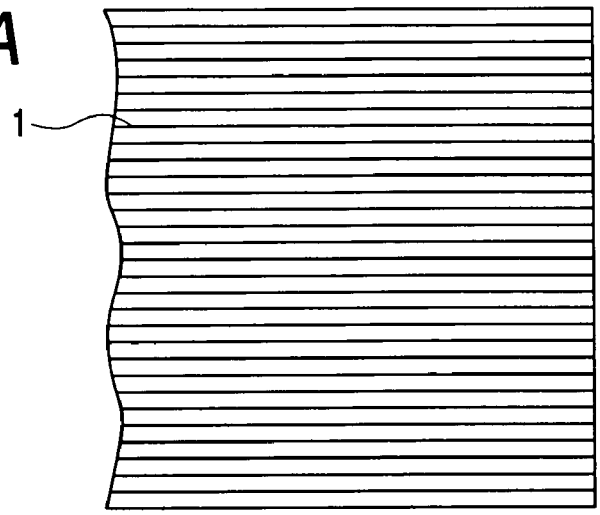
FIGS. 3A and 3B are diagrams showing an example of a conventional supporting structure.
Figure 3B:
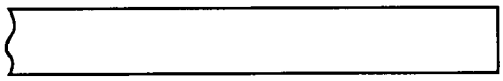

FIGS. 3A and 3B show a conventional supporting structure manufactured by cutting a drawn glass substrate by a diamond cutter, for example, in a glass scriber. As shown in the drawings, the configuration of the end portion (cut portion) parallel to the lateral direction is very sharp-edged, with the ridge lines of the grooves 1 clearly reaching the ridge line of the section. Further, in such a supporting structure, there exist a few minute cracks (chips and flaws) in the ridge line of the section, causing stress concentration, which is disadvantageous from the viewpoint of fracture resistance. This is also likely to cause chipping during handling.

Figure 4A:
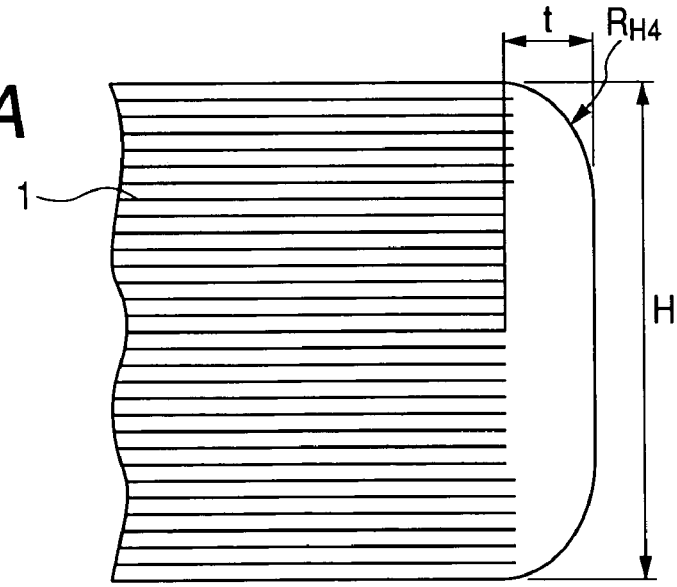
FIGS. 4A and 4B are diagrams showing a supporting structure according to another preferred embodiment mode of the present invention.
Figure 4B:
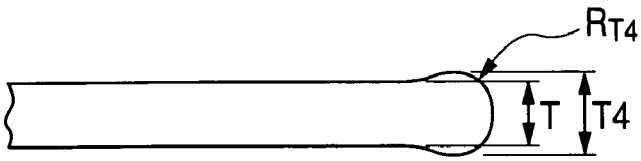

FIGS. 4A and 4B show a preferred embodiment mode of the second supporting structure of the present invention. In this embodiment mode, at an end portion parallel to the lateral direction, there is formed a curved portion ($R_{T4}$) having larger radius of curvature than the thickness (T) of the supporting structure, with the result that the curved portion serves as a reinforcing member of the end portion, thereby achieving an improvement in terms of fracture resistance. In the case of this embodiment mode, while the grooves 1 may reach the end portions parallel to the lateral direction, when the supporting structure is manufactured by the manufacturing method of the present invention described below, the grooves 1 do not substantially reach the end portions parallel to the lateral direction. Further, when, in particular, the length (t) of the region with no grooves 1 is larger than the thickness (T) of the supporting structure in order that the grooves 1 may be intentionally prevented from reaching the end portions parallel to the lateral direction, a further improvement is achieved in terms of fracture resistance as compared with the supporting structure of FIGS. 1A and 1B, so it is desirable. Further, the rounded configuration ($R_{H4}$) in the height direction (H) also tends to be larger than that of the supporting structure of FIGS. 1A and 1B, so it is also desirable.

When incorporating the supporting structure of the present invention into the display apparatus as shown in FIG. 8, the regions with no grooves are fixed with the spacer fixing blocks 92, thus realizing an arrangement in which the display region is not affected.

Next, the method of manufacturing a supporting structure according to the present invention will be described. A supporting structure according to the present invention is obtained by performing heat drawing on a glass base material in a parallel direction in the form of a flat plate having in its surface a plurality of parallel grooves (of the same number as the grooves of the supporting structure) and by cutting the resultant glass substrate to a predetermined length. In the manufacturing method of the present invention, laser irradiation is effected from a direction perpendicular to the surface having the grooves of the glass substrate in the above-mentioned cutting process, and one side portion of the glass substrate is pulled, with the irradiation region being molten, to thereby effect cutting. That is, in the manufacturing method of the present invention, the glass substrate is locally heated by using a laser beam of high light directivity, with the result that only the irradiation region of the glass substrate is melted to fill the grooves, and the portions other than the irradiation region allow to be cut while maintaining the groove configuration. Further, by adjusting the irradiation condition and the condition for pulling the glass substrate, it is possible to easily form the end portion (the end portion parallel to the lateral direction) in a configuration as shown in FIGS. 1A, 1B, 4A, and 4B.

The wavelength of the laser beam used in the present invention may be in any range as long as the glass substrate, which is the object of cutting, can efficiently absorb the laser beam. Examples of the laser beam to be used include a $CO_2$ (carbon dioxide) laser with a wavelength of 10.6 μm, and a YAG laser with a wavelength of 1.06 μm. In particular, the $CO_2$ laser, which exhibits high absorptance with respect to glass, is desirable.

Further, the output and frequency of the laser beam must be selected according to the form (material, thickness, and width), etc. of the glass substrate. When the power of the laser beam is too large, the temperature rise in the irradiation region is too quick, resulting in generation of cracks in the cut portion, or burning, evaporation, scattering, etc. of the glass substrate to cause contamination of the environment around the glass substrate. When the oscillation frequency is reduced to avoid such problems, the temporal (intermittent) changes in the temperature of the irradiation region will become large, sometimes resulting in generation of cracks. Thus, the frequency of the laser beam is set as high as possible, and the laser beam is applied little by little, thereby mitigating the temporal fluctuations in temperature. Further, the power of the laser is set within a range allowing the cutting of the glass substrate as described below.

When, as in the case of the present invention, a laser beam is applied to a glass substrate that has undergone heat drawing, it is necessary to apply a laser beam in a range as small as possible with respect to the drawing direction and as uniformly as possible with respect to the height (H) direction in order to effect cutting without involving generation of any unnecessary molten substance and generation and scattering of dust.

More specifically, it might be possible to condense a laser beam into a spot of approximately several μm to several tens of μm to perform scanning in the height direction, or to form the irradiation region through a mask. In the former method, however, the scanning with a spot light leads to great temporal changes in the temperature of the cut portion, and cracks are often generated in the glass substrate. To avoid this, it might be possible to increase the scanning speed; however, in a system in which scanning is effected by mechanically swinging a mirror, there are limitations in the scanning speed. On the other hand, the latter method cannot be said to be optimum, either. For, the wavelength of the $CO_2$ or YAG laser beam is large so that the pattern accuracy with respect to masking is rather low (i.e., the pattern border is blurred), and further, the wear of the mask is intense (there are few such mask materials available as can efficiently reflect or absorb laser beam).

Figure 5A:
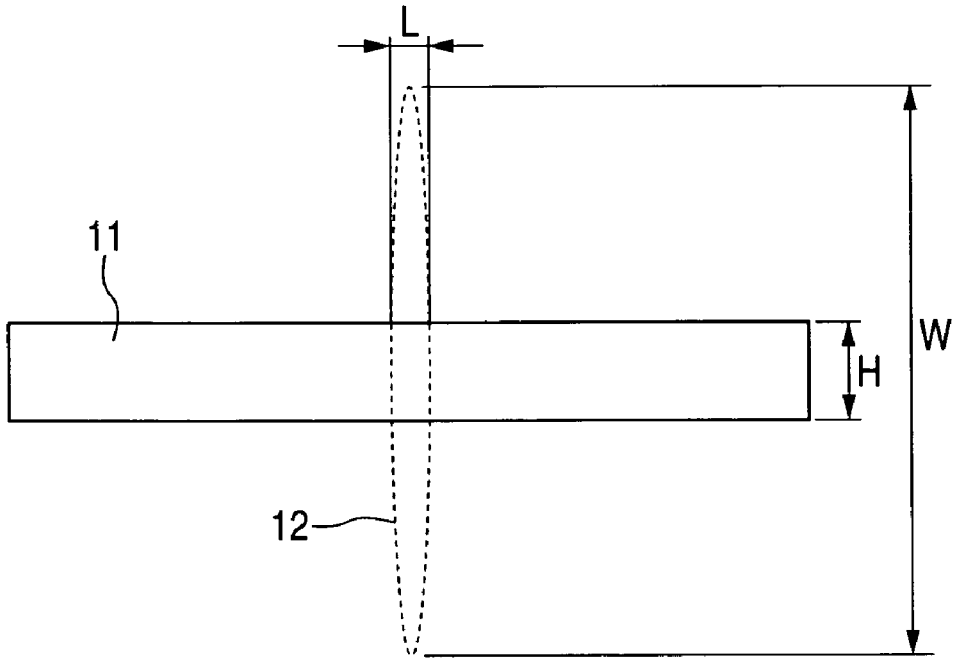
FIGS. 5A and 5B are diagrams showing a laser irradiation pattern in a manufacturing method of the present invention.
Figure 5B:
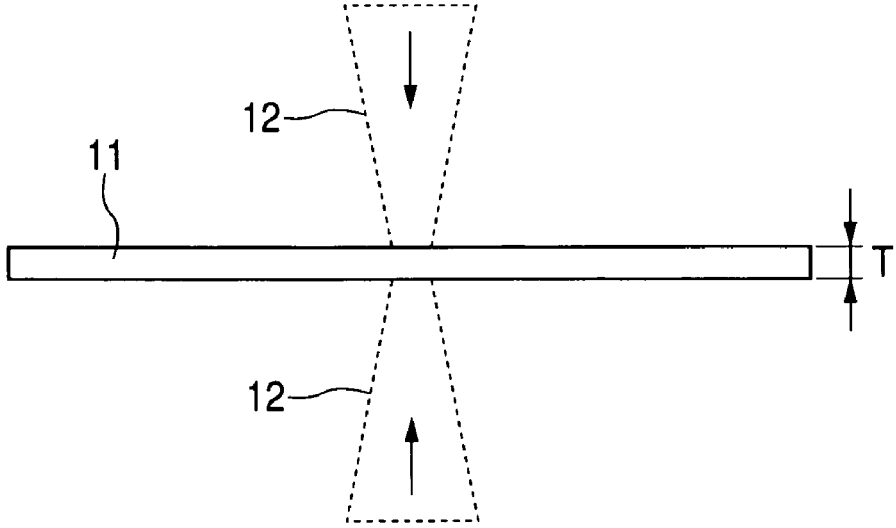
Figure 6:
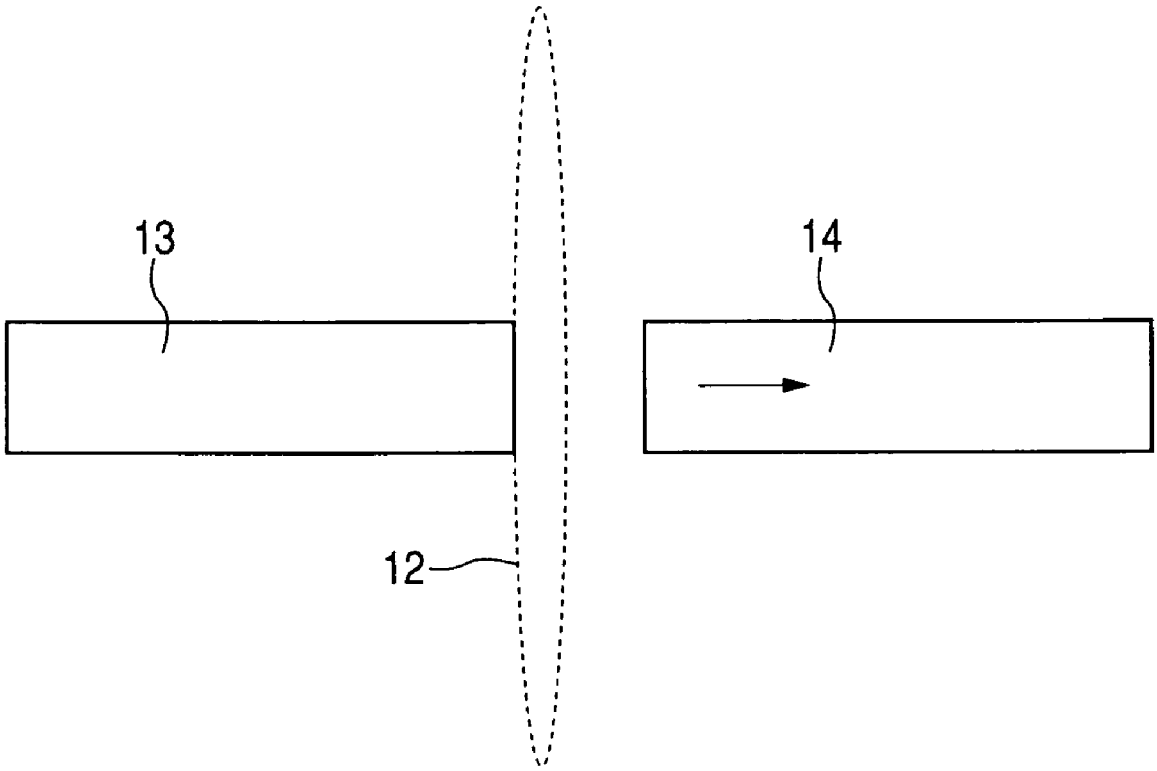
FIG. 6 is a diagram showing a cutting process in the manufacturing method of the present invention.

FIGS. 5A and 5B show a most preferable system. In the drawings, numeral 11 indicates a drawn glass substrate, and numeral 12 indicates the irradiation pattern of a laser beam. As shown in FIGS. 5A and 5B, the laser beam itself is condensed into a thin and narrow pattern 12 through a cylindrical lens, and irradiation is effected such that the longitudinal direction (W) of the irradiation pattern 12 is the height (H) direction of the supporting structure. Further, by effecting irradiation simultaneously from both sides of the glass substrate 11, it is possible to perform heating more efficiently with respect to the thickness (T) direction of the glass substrate 11. In this case, it is necessary to perform positioning to a sufficient degree of the irradiation pattern 12 on either side.

Figure 7:
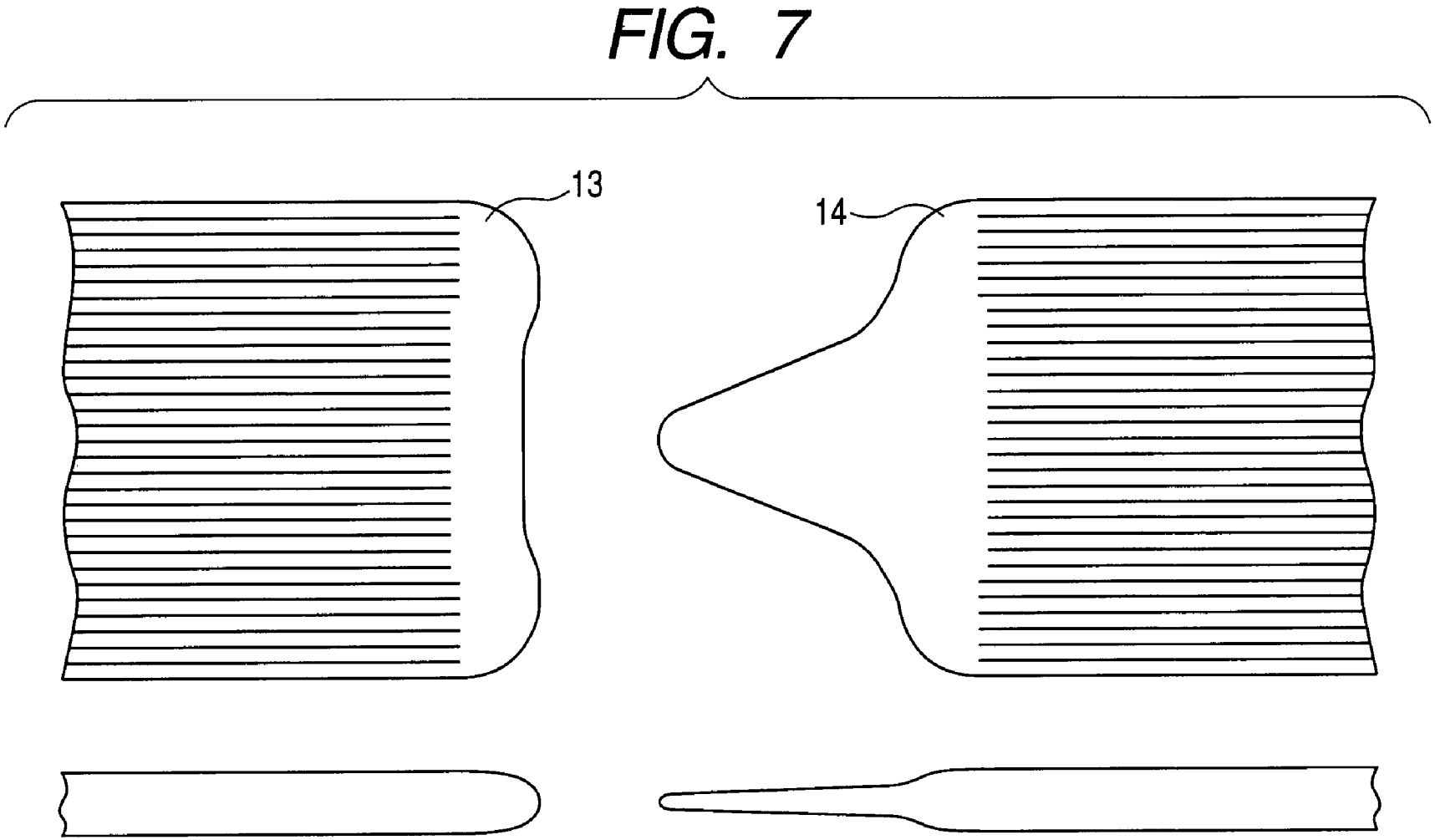
FIG. 7 is a diagram showing a cut portion of a glass substrate after cutting in the manufacturing method of the present invention.

As shown in FIGS. 5A and 5B, with the irradiation region of the glass substrate 11 being melted through irradiation with laser beam, one side portion 13 with respect to the laser irradiation pattern 12 at the center (constituting a border) is fixed, and the other side portion 14 is pulled, with the result that it is possible to obtain a cut configuration as shown in FIG. 7. The one, fixed side portion is used as the product, and the other side portion 14, which has been pulled, is discarded.

While the molten substance is being caused to move by pulling the other side portion 14 after melting the glass substrate 11, it is desirable to continue irradiation with laser beam. When the irradiation with laser beam is stopped halfway through the pulling of the molten substance, the temperature of the molten substance decreases abruptly (due to heat radiation), and the substance is solidified during the pulling (i.e., in the stringy state), so that it is impossible to finish the end portion of the one side portion 13 in a desired configuration. The reverse curved configuration as shown in FIGS. 2A and 2B is obtained by cutting in the similar condition.

Further, by setting the laser irradiation time long and raising the melting temperature (The melting area also increases with the passage of time), it is possible to increase the volume of the molten portion. Thus, it is so arranged that the molten substance remains on one side portion 13 when the other side portion 14 is pulled, whereby it is possible to obtain a cut portion with a large radius of curvature as shown in FIGS. 4A and 4B.

EMBODIMENTS

Embodiment 1

As shown in FIGS. 5A and 5B, laser irradiation was performed from both sides for three seconds to form a laser irradiation pattern of a longitudinal length (W) of 6 mm and a width (L) of 1.5 mm on a glass substrate obtained through heat drawing machining (material: non-alkali glass, height (H): 1.6 mm, thickness (T): 0.195 mm, groove depth: 8 μm, number of grooves: 40, groove width: 15 μm, groove pitch: 30 μm).

As the laser oscillator, a $CO_2$ laser with a power of 10 W (model 48-1 W manufactured by Shinrad). A laser beam of 2 mmϕ was expanded to 6 mmϕ by a beam expander, and the optical path was divided into two by a beam splitter in order to perform irradiation on both sides of the glass substrate, with the optical paths being opposed to each other with the glass substrate therebetween. By condensing light in front of the glass substrate with a cylindrical lens of a focal distance of 2.5 inches, irradiation with an irradiation pattern of the above-mentioned size was effected on both sides of the glass substrate.

The laser output conditions were as follows: frequency: 5 kHz, power: 7.0 W (with the pulse duty set at 30%). Regarding the pulling conditions, the pulling was started two seconds after the laser irradiation starts, with the pulling rate being 7 mm/sec. The pulling distance was 10 mm.

As the result of cutting the glass substrate under the above-mentioned conditions, there was obtained a cut portion having a configuration as shown in FIGS. 1A and 1B, and having a non-groove-region length (t) of 0.2 mm, with the $R_{T1}$ being of an outwardly protruding, smooth, and rounded configuration.

Thirty-two buckling tests were performed respectively on supporting structures obtained by the cutting according to this example, and supporting structures obtained by using a conventional cutting method to examine them for fracture resistance. The test results are shown in Table 1. In the table, the term "dicer" means a supporting structure obtained by cutting a glass substrate by a conventional system in which glass plate, silicon wafer or the like is cut by using a tool such as a diamond grindstone. The configuration of the section of this supporting structure is akin to that shown in FIGS. 3A and 3B.

However, since the entire section is a sliding surface, there exist innumerable minute cracks.

The buckling tests were performed by using the tension and compression fatigue tester AGS-20KNG manufactured by Shimadzu Corporation, effecting compression at a rate of 0.05 mm/min. A glass block was used as a presser for compressing the specimens. The spacer used in the buckling strength test has a length of 40 mm.

As is apparent from Table 1, the supporting structure of the present invention has a buckling strength nearly 1.5 times as high as that of the supporting structure manufactured by the conventional manufacturing method, thus proving superior in fracture resistance.

TABLE 1

| Compressive Strength | Frequency of Occurrence | |
|---|---|---|
| (MPa) | Embodiment 1 | Dicer |
| $\sigma \leqq 150$ | 0 | 5 |
| $150 < \sigma \leqq 250$ | 0 | 23 |
| $250 < \sigma \leqq 350$ | 0 | 3 |
| $350 < \sigma \leqq 450$ | 1 | 1 |
| $450 < \sigma \leqq 550$ | 8 | 0 |
| $550 < \sigma$ | 23 | 0 |

Embodiment 2

A glass substrate was cut in the same manner as in Example 1 except that the power of the laser beam was 5.2 W. As a result, as shown in FIGS. 2A and 2B, the cut portion exhibited a reversely curved configuration $R_{T2}$.

Embodiment 3

A glass substrate was cut in the same manner as in Example 1 except that the power of the laser beam was 8.6 W. As a result, there was obtained a curved cut portion configuration in which the radius of curvature of the portion $R_{T4}$ was 0.22 mm, which is larger than the thickness of 0.195 mm.

This application claims priority from Japanese Patent Application No. 2004-227516 filed Aug. 4, 2004, which is hereby incorporated by reference herein.

What is claimed is:

1. A method of manufacturing a plate-like spacer in a display panel which supports opposing upper and lower substrates of the display panel in a vacuum space and has in its surface a plurality of grooves, the method comprising the steps of:

subjecting a plate-like glass base material having in its surface a plurality of grooves to heat drawing in a direction parallel to the grooves; and cutting the glass base material after the heat drawing, with irradiation of a laser beam condensed to have a thin and narrow elongated pattern on the surface of the glass base material from a direction perpendicular to the surface having the grooves of the glass base material, the thin and narrow elongated pattern extending across the grooves and beyond the width of the drawn glass base material in the elongated direction, wherein in the step of cutting the glass base material, with an irradiation region of the glass base material irradiated with the laser beam being molten, one side portion of the glass base material with respect to the irradiation region is fixed, and the other side portion of the glass base material is pulled to thereby tear off the other side portion from the one side portion of the glass base material which becomes the spacer.

2. A method of manufacturing a display apparatus, the method comprising the steps of:

subjecting a plate-like glass material having in its surface a plurality of grooves to heat drawing in a direction parallel to the grooves; and cutting the glass base material after the heat drawing, with irradiation of a laser beam condensed to have a thin and narrow elongated pattern on the surface of the glass base material from a direction perpendicular to the surface having the grooves of the glass base material, the thin and narrow elongated pattern extending across the grooves and beyond the width of the drawn glass base material in the elongated direction, wherein in the step of cutting the glass base material, with an irradiation region of the glass base material irradiated with the laser beam being molten, one side portion of the glass base material with respect to the irradiation region is fixed, and the other side portion of the glass base material is pulled to thereby tear off the other side portion from the one side portion of the glass material; and arranging the one side portion fixed at the cutting step and cut from the glass base material as a spacer between a first substrate having an electron-emitting device and a second substrate having a light emitting member that emits light through irradiation with electrons emitted from the electron-emitting device.

3. A method according to claim 1, wherein in the step of cutting the glass base material, the grooves do not extend to an end portion of the spacer.

4. A method according to claim 1, wherein in the step of cutting the glass base material, an end portion of the spacer is rounded.

5. A method according to claim 2, wherein in the step of cutting the glass base material, the grooves do not extend to an end portion of the spacer.

6. A method according to claim 2, wherein in the step of cutting the glass base material, an end portion of the spacer is rounded.

* * * * *